US006840842B2

(12) United States Patent
Hirai et al.

(10) Patent No.: US 6,840,842 B2
(45) Date of Patent: Jan. 11, 2005

(54) BURNISHING PAD, BURNISHING MACHINE EQUIPPED WITH BURNISHING PAD AND BURNISHING METHOD

(75) Inventors: Miyoko Hirai, Aichi (JP); Yukio Suzuki, Aichi (JP); Kazuo Irobe, Tokyo (JP); Takanobu Haruki, Ibaraki (JP); Yoshihiro Suzuki, Ibaraki (JP); Naohiko Shimono, Ibaraki (JP); Hiroki Kanamaru, Tokyo (JP)

(73) Assignees: Toyo Cushion Co., Ltd., Obu (JP); Japan Vilene Company, Ltd., Tokyo (JP)

( * ) Notice: Subject to any disclaimer, the term of this patent is extended or adjusted under 35 U.S.C. 154(b) by 198 days.

(21) Appl. No.: 10/316,915

(22) Filed: Dec. 12, 2002

(65) Prior Publication Data

US 2003/0124958 A1 Jul. 3, 2003

(30) Foreign Application Priority Data

Dec. 13, 2001 (JP) ..... 2001-380684
Feb. 21, 2002 (JP) ..... 2002-045126
Oct. 31, 2002 (JP) ..... 2002-317541

(51) Int. Cl.[7] ..... B24B 1/00

(52) U.S. Cl. ..... 451/28; 451/28; 451/259; 451/350; 451/352; 451/353; 451/526; 451/527; 451/532; 451/536

(58) Field of Search ..... 451/28, 259, 350, 451/352, 353, 526, 527, 532, 536

(56) References Cited

U.S. PATENT DOCUMENTS 5,340,642 A * 8/1994 Baumgartl et al. ..... 428/224
5,539,042 A * 7/1996 Birch ..... 524/503
5,685,042 A * 11/1997 Demetriades ..... 15/230.12

FOREIGN PATENT DOCUMENTS

JP 4-82673 3/1962

* cited by examiner

*Primary Examiner*—Joseph J. Hail, III
*Assistant Examiner*—Shantese McDonald
(74) *Attorney, Agent, or Firm*—Oblon, Spivak, McClelland, Maier & Neustadt, P.C.

(57) ABSTRACT

An objective of the present invention is to provide a burnishing pad, capable of removing dirt by burnishing a place (i.e., a dirty point) onto which dirt attaches to impart sufficient luster, and being biodegraded; a burnishing machine equipped with the burnishing pad; and a burnishing method using the burnishing pad. The burnishing pad of the invention is comprised of a lock-like fiber composite in which adjacent fibers are bonded at intersection thereof, wherein said fiber is at least one selected from the group consisting of a vegetable fiber and an animal fiber. And another burnishing pad is a fiber composite comprised of thick fibers of 150 $\mu$m or more in fiber diameter. These pads can be equipped with a porous supporting layer, respectively. The porous supporting layer has a mean 5% modulus strength of 20 N/5 cm width or more at 70° C. and a unit area weight of 100 g/m$^2$ or less.

19 Claims, 2 Drawing Sheets

BURNISHING PAD, BURNISHING MACHINE EQUIPPED WITH BURNISHING PAD AND BURNISHING METHOD

FIELD OF THE INVENTION

The present invention relates to a burnishing pad, a burnishing machine equipped with the burnishing pad and a burnishing method. More particularly, the present invention relates to a burnishing pad, capable of removing dirt by burnishing a place (i.e., a dirty point) onto which dirt attaches to impart sufficient luster, and being biodegraded; a burnishing machine equipped with the burnishing pad; and a burnishing method using the burnishing pad.

The burnishing pad of the present invention is used as a burnishing member or a cleaning member for a surface of a floor, a wall and the like, particularly for a surface of a floor coated with a wax in a store, a supermarket, a department store, a building, a hall, a railway station and others.

DESCRIPTION OF THE PRIOR ART

In general, a burnishing machine such as a burnisher is used in cleaning a surface of a floor, a wall and the like in a store, a supermarket, a department store, a building, a hall, a railway station and others in order to impart luster thereto. In a prior art practice, a disk-like burnishing pad made of non-woven fabric from chemical fibers such as of Nylon, polyester or the like was mounted to such a burnishing machine and rotation-pressed onto a floor in usage thereof. A non-woven fabric of chemical fibers has elasticity and easy to be conformable with depressions and projections on a surface to be burnished by pressing the fabric to a face to be burnished such as a floor and the like, thereby enabling removal of dirt on dirty points and impartation of luster thereon with the help of a proper frictional force due to the rotation.

In a case where a burnishing pad made of chemical fibers is used, however, the pad has a difficulty in sufficiently removing dirt attached onto a point to be burnished and in imparting luster thereon, though, according to a kind of the dirt because of being too soft and weak in frictional force. Therefore, there has been a demand for a burnishing pad with which dirt can be removed by a proper frictional force to impart sufficient luster thereon without giving any injuries on a face to be burnished.

In addition, a pad made of chemical fibers has had a problem of an environmental pollution since the pad produces a harmful gas in incineration disposal as waste after use or because of non-biodegradability thereof when being buried deep within the earth. For this reason, there has been a desire for a burnishing pad with no fear of environmental pollution and biodegradability in case where the pad is thrown away as waste.

Moreover, in a case where a burnishing machine equipped with such a burnishing pad is used, a centrifugal force acts on the burnishing pad by the rotation, an edge of the burnishing pad extends outwardly to increase an outer diameter thereof and as a result, comes into contact with the outer frame in the neighborhood of the burnishing pad in the burnishing machine, thereby having arisen a case where a smooth burnishing operation is disabled.

In order to solve such a problematic point, a proposal on production of a rotary disk for floor maintenance is made in JP A 4-82673 in which non-woven fabrics are laminated on both surfaces of a reinforcement core and a hooking needle is caused to pass through the reinforcement core to thereby bonding fibers of both non-woven fabrics, followed by cutting out a disk from the laminate, coating of an adhesive agent, spraying abrasive particles thereonto and drying it. This rotary disk is harder to receive an influence of the centrifugal force of the rotation and more excellent in a polishing operability as compared with a burnishing pad comprised of a chemical fiber non-woven fabric as described above.

Even in a case where this rotary disk was used, however, a polishing pad was easy to receive an influence of the rotational force, a load on the polishing machine was large and there was a high possibility of reducing a lifetime of the polishing machine.

That is to say, in the rotary disk, though the reinforcement core is used, the hooking needle passes therethrough to thereby reduce strength of the reinforcement core and the polishing pad receives an influence of a rotational force and to thereby, cause itself to be put into contact with the outer frame in the neighborhood of the polishing pad in the polishing machine; having led to a case where a polishing operation cannot be smoothly performed. While an increased unit area weight of the reinforcement core can be conceived in order to enhance a reinforcement ability of the reinforcement core, in this case a unit area weight of all of the rotary disk results in increase; therefore, there arose increase in load on a motor for rotation of the polishing pad with a resulting possibility of a shorter lifetime of the motor, and furthermore, with another result that a heavier weight of the polishing machine as a whole led to another possibility of a poorer polishing operation itself.

SUMMARY OF THE INVENTION

The present invention solves the problems associated with prior arts described above. And an object of the present invention is to provide a burnishing pad capable of removing dirt by burnishing a point to be burnished onto which dirt attaches to impart sufficient luster, and being biodegraded; a burnishing pad further capable of smoothly performing a burnishing operation without coming into contact with the outer frame in the neighborhood of the burnishing pad in the burnishing machine, and having a small load on the burnishing machine; a burnishing machine equipped with the burnishing pad, and a burnishing method using the burnishing pad.

In order to attain the above-mentioned object, the present inventors studied intensively and, as a result, it is found that, using a burnishing pad comprised of a lock-like fiber composite in which adjacent fibers are bonded at intersection thereof, wherein the fiber is at least one selected from the group consisting of a vegetable fiber and an animal fiber, or using a burnishing pad which is a fiber composite comprised of thick fibers of 150 $\mu$m or more in fiber diameter lead to removing dirt attached onto a floor and the like with a proper frictional force to impart the surface sufficient luster. And it is also found that, an influence of a rotational force in a case where the rotary disk is used adversely affects the burnishing pad to extend with ease, due to heating to a temperature of the rotary disk of the order of 70° C. by heat generated by friction with a surface of a floor, by which an adhesive agent bonding fibers constituting non-woven fabric is softened, in addition to the reason of a hooking needle passing therethrough.

The present invention is described as follows.

1. A burnishing pad characterized in that it is comprised of a lock-like fiber composite in which adjacent fibers are bonded at intersection thereof, wherein the fiber is at least one selected from the group consisting of a vegetable fiber and an animal fiber.

2. The burnishing pad according to 1 above, wherein the vegetable fiber is at least one selected from the group consisting of sisal hemp fiber, palm fiber, manila hemp fiber, cellulose fiber and bass fiber.

3. The burnishing pad according to 1 above, wherein the animal fiber is at least one selected from the group consisting of human hair, pig hair, sheep hair, goat hair, horse hair, deer hair, rabbit hair, wild boar hair and camel hair.

4. The burnishing pad according to 1 above, further comprising a porous supporting layer on one side of the fiber composite or between fiber composites.

5. A burnishing pad characterized in that it is comprised of a fiber composite of thick fibers of 150 μm or more in fiber diameter.

6. The burnishing pad according to 5 above, wherein the fiber is comprising at least a vegetable fiber selected from the group consisting of the vegetable fiber, an animal fiber and a synthetic fiber.

7. The burnishing pad according to 6 above, wherein the vegetable fiber is at least one selected from the group consisting of sisal hemp fiber, palm fiber, manila hemp fiber, cellulose fiber and bass fiber.

8. The burnishing pad according to 5 above, further comprising a porous supporting layer on one side of the fiber composite or between fiber composites.

9. The burnishing pad according to 8 above, wherein the porous supporting layer has a mean 5% modulus strength of 20 N/5 cm width or more at 70° C. and a unit area weight of 100 g/m$^2$ or less.

10. The burnishing pad according to 8 above, wherein the porous supporting layer is comprised of at least one material selected from the group consisting of a long fiber non-woven fabric, a warp weft orthogonal non-woven fabric and a net.

11. The burnishing pad according to 10 above, wherein the long fiber non-woven fabric is a spunbonded non-woven fabric.

12. A burnishing machine characterized in that it is equipped with a burnishing pad comprised of a lock-like fiber composite in which adjacent fibers are bonded at intersection thereof, wherein the fiber is at least one selected from the group consisting of a vegetable fiber and an animal fiber.

13. The burnishing machine according to 12 above, wherein the burnishing pad comprises further a porous supporting layer on one side of the fiber composite or between fiber composites.

14. A burnishing machine characterized in that it is equipped with a burnishing pad which is a fiber composite comprised of thick fibers of 150 μm or more in fiber diameter.

15. The burnishing machine according to 14 above, wherein the burnishing pad comprises further a porous supporting layer on one side of the fiber composite or between fiber composites.

16. The burnishing machine according to 15 above, wherein the porous supporting layer has a mean 5% modulus strength of 20 N/5 cm width or more at 70° C. and a unit area weight of 100 g/m$^2$ or less.

17. A burnishing method characterized in burnishing a dirty point using a burnishing pad comprised of a lock-like fiber composite in which adjacent fibers are bonded at intersection thereof, wherein the fiber is at least one selected from the group consisting of a vegetable fiber and an animal fiber.

18. The burnishing method according to 17 above, wherein burnishing is performed without a detergent and an abrasive agent.

19. A burnishing method characterized in burnishing a dirty point using a burnishing pad which is a fiber composite comprised of thick fibers of 150 μm or more in fiber diameter.

20. The burnishing method according to 19 above, wherein burnishing is performed without a detergent and an abrasive agent.

The burnishing pads of the present invention are comprised of a lock-like fiber composite in which adjacent fibers are bonded at intersection thereof, wherein the fiber is at least one among a vegetable fiber and an animal fiber, or is comprised of a fiber composite of thick fibers of 150 μm or more in fiber diameter, respectively, and have a proper hardness and are capable of effectively removing an attaching dirt to impart luster at a burnished point. These burnishing pads comprising a vegetable fiber produce no harmful gas even when being burned, and since the pad are biodegradable in a state being buried in underground, no environmental pollution occurs when the pad are thrown away as waste. In particular, a specific fiber such as sisal hemp fiber leads to a more effective removal of dirt and a gloss at a burnished point. Further, because of light weight, a load on a burnishing machine equipped with the burnishing pad can be reduced in burnishing or cleaning with the burnishing machine.

In the case of a burnishing pad further comprising a porous supporting layer, the pad can be firmly attached to the burnishing machine. The porous supporting layer having a prescribed characteristic leads to a reduced deterioration due to frictional heat and deformation of the pad.

According to the burnishing machine of the present invention, dirt can be easily removed and luster can be imparted to a burnished point since the machine has a burnishing pad described above. The burnishing pad is not easy to deform and the burnishing machine gives a smooth operation without putting the burnishing pad into contact with an outer flame in the neighborhood of the pad in the burnishing machine even under influences of a rotational force and frictional heat. In addition, the burnishing machine itself is of light weight and has a long lifetime.

According to the burnishing method, dirt can be easily removed without a detergent and the like, and it gives an excellent workability. In the case of burnishing a surface coated with a wax, removing a part of a surface of the wax coated on a floor leads to a glazing surface while exposing an inner portion of the wax on the floor surface.

DETAILED DESCRIPTION OF THE INVENTION

Hereinafter, embodiments of the present invention will be explained specifically.

The burnishing pad of the first aspect of the present invention is characterized in that it is comprised of a lock-like fiber composite in which adjacent fibers are bonded at intersection thereof, wherein the fiber is at least one selected from the group consisting of a vegetable fiber and an animal fiber.

The vegetable fiber is not particularly limited and includes sisal hemp fiber, palm fiber, manila hemp fiber, cellulose fiber, bass fiber and the like. These fibers may be used alone or in combination of two or more. Among them, preferred are sisal hemp fiber and palm fiber having a proper hardness. A mixing ratio in the case where both sisal hemp fiber and palm fiber are employed is not specifically limited but adjustable in any suitable way, while sisal hemp fiber can be preferably in the range of 10 to 90% by weight, more preferably in the range of 30 to 70% by weight and further preferably in the range of 40 to 60% by weight based on 100% by weight of the total of a mixture of sisal hemp fiber and palm fiber.

An oily component is contained in such a kind of fibers and dirt attached on a floor and the like can be removed easily by the oily component to impart the surface sufficient luster.

The animal fiber is not also particularly limited and includes human hair, pig hair, sheep hair, goat hair, horse hair, deer hair, rabbit hair, wild boar hair, camel hair and the like. These fibers may be used alone or in combination of two or more. Among them, preferably employed is at least one kind of human hair and pig hair with a proper hardness. A mixing ratio in the case where human hair and pig hair are employed is not specifically limited but adjustable in any suitable way, while human hair can be preferably in the range of 10 to 90% by weight, more preferably in the range of 30 to 70% by weight and further preferably in the range of 40 to 60% by weight based on 100% by weight of the total of a mixture of human hair and pig hair.

An oily component is contained in such a kind of fibers and dirt attached on a floor and the like can be removed easily by the oily component to impart the surface sufficient luster.

The fiber constituting the lock-like fiber composite is just a vegetable fiber or a mixture of the vegetable fiber and the animal fiber. In the case where the lock-like fiber composite is constituted of a vegetable fiber, the vegetable fiber is preferably at least one among sisal hemp fiber and palm fiber. Especially preferable is a case where the vegetable fiber is sisal hemp fiber.

In the case where a lock-like fiber composite is constituted of a vegetable fiber and an animal fiber, any one of them may be used, while the vegetable fiber is preferably at least one among sisal hemp fiber and palm fiber. Furthermore, preferably is a case where the animal fiber is at least one among human hair and pig hair. More preferable is a case where the vegetable fiber is at least one among sisal hemp fiber and palm fiber, and the animal fiber is at least one among human hair and pig hair. Especially preferable is a case where the vegetable fiber is at least one among sisal hemp fiber and palm fiber, and the animal fiber is pig hair.

A mixing ratio of the vegetable fiber and the animal fiber is adjustable in any suitable way depending on fibers of kinds in combination, a desired hardness and others and is not particularly limited. A content of the vegetable fiber is preferably in the range of 10 to 90% by weight, more preferably in the range of 20 to 90% by weight, further preferably in the range of 30 to 90% by weight and further more preferably in the range of 30 to 80% by weight and especially preferably in the range of 40 to 80% by weight based on 100% by weight of the total of the vegetable fiber and the animal fiber.

An adhesive agent is used for bonding at intersections of adjacent fibers of the lock-like fiber composite. The adhesive agent includes a poly vinyl acetate resin-based adhesive agent, a polyurethane resin-based adhesive agent, a nitrile rubber-based adhesive agent and the like. In addition, a latex containing rubber component, a thermoplastic resin emulsion and others can be also used. These adhesive agents can also be used in a properly diluted state with water or an organic solvent such as methanol.

The latex includes a latex of natural rubber and a latex of synthetic rubbers such as styrene-butadiene rubber, isoprene rubber, butadiene rubber and nitrile-butadiene rubber. And the thermoplastic resin emulsion includes emulsions containing a synthetic resin such as polyester, polyethylene, ethylene-vinyl acetate copolymer, polystyrene, poly vinyl acetate, polyacrylate, polymethacrylate and polyvinyl chloride. The latex containing rubber component and the thermoplastic resin emulsion with water as a dispersion medium are preferable with respect to easy handling, working environment and others. A surface of the fiber may be covered with the adhesive agent.

A fabrication method of the lock-like fiber composite is not particularly limited, but it can be produced as follows. First, fibers are accumulated and entangled by a dry method (for example, an air laying process). Then, the fiber composite is immersed in a solution of an adhesive agent, a latex or an emulsion described above and others. And after picking the composite out from the solution, a medium for use in dissolution or suspension is drying-removed. Or a method in which the solution is sprayed on the fibers, followed by drying-removal of the medium for use in dissolution, suspension of an adhesive agent. In such cases, fibers in the lock-like fiber composite may be oriented in a specific direction or oriented in directions three-dimensionally, while the composite having the latter orientations in directions three-dimensionally is preferable because of proper elasticity obtained and easier conformability with depressions and projections on a surface to be burnished.

Drying for removal of a medium in which the adhesive agent dissolved or suspended may be performed under an atmospheric pressure at tens of degrees centigrade over a long time, or at 100° C. or higher within a short time, whereas it is not preferable to expose to an excessively high temperature in consideration of degradation of fibers and others; therefore, heating at tens of degrees centigrade to dry under a reduced pressure in a vacuum dryer is preferable giving consideration into any of degradation in fibers, a time consumed for drying, a drying efficiency and others.

An amount of the adhesive agent to be used is not limited and it is enough if it is the amount which can bond fibers at least and can maintain the form when the burnishing pad is used. Further it is enough to shows a proper hardness of the burnishing pad for glazing. In addition, the amount is different according to a kind of thick fibers and a unit area weight of the fiber composite and the like. The amount of the adhesive agent can be set in any suitable range through repetition of experiments.

Characteristics such as hardness of the lock-like fiber composite can be adjusted in any way by properly selecting immersion conditions such as an amount of fibers, a viscosity of an adhesive agent solution in usage, a concentration of rubber component in a latex or a concentration of a thermoplastic resin in an emulsion, a temperature and a time; and spraying conditions such as temperature, a spraying time, the number of spraying runs and the like.

As the lock-like fiber composite, commercially available products can be employed. Example includes "sisal lock" and "palm lock" which are manufactured by TOYO Cushion CO., LTD. and the like. In cases where such commercially available products are employed, a product may be used in the form as purchased, but it is usually used after shaping into a proper form or size, cutting or the like.

A shape of the burnishing pad of the first aspect of the present invention is not particularly limited, while being adjustable according to dimensions of a pad mounting section of a burnishing machine in use or the like.

In the case where a rotational driving type burnishing machine is used, for example, a disk-like fiber composite 2 (see FIG. 1) and the like are adopted as the burnishing pad 1. A diameter of the burnishing pad in that case is preferably in the range of 100 to 800 mm, more preferably in the range of 200 to 700 mm and further preferably in the range of 300 to 600 mm. With such diameters in the ranges adopted, dirt on a surface to be burnished is sufficiently removed to impart luster thereon.

A thickness of the burnishing pad (a value measured with a metal measure or a caliper under no load condition) is preferably in the range of 5 to 50 mm, more preferably in the range of 5 to 40 mm and further preferably in the range of 5 to 30 mm. With thickness values in such ranges adopted, there can be obtained a proper elasticity and easy conformability with depressions and projections on a surface to be burnished, leading to improvement on removability of dirt.

The burnishing pad 1 may be the one obtained by cutting or the like of only one sheet of lock-like fiber composite 2, or the one obtained by adhering two or more sheets (2*a* & 2*b*) to each other (adhesive layer 3) to increase strength (see FIG. 2). Furthermore, in order to improve strength, a laminated wood or woods or the like may be inserted between plural lock-like fiber composites to form a burnishing pad.

The burnishing pad of the second aspect of the present invention is characterized in that it is comprised of a fiber composite of thick fibers of 150 μm or more in fiber diameter. A fiber constituting the fiber composite is not particularly limited, but it includes a vegetable fiber, an animal fiber and a synthetic fiber. These fibers can be used alone or in combination of two or more.

The vegetable fiber and the animal fiber according to the second aspect are the same ones described in the first aspect. Sisal hemp fiber and palm fiber are preferred as the vegetable fiber. In addition, the synthetic fiber includes polyester fiber, Nylon fiber and the like.

A fiber constituting the fiber composite is preferably comprising at least vegetable fiber among these. A content of the vegetable fiber is preferably 60% by weight or more, more preferably 70% by weight or more and may be 100% by weight.

A diameter of the fiber is 150 μm or more so as to have a proper hardness. With thicker fibers adopted, a higher hardness can be ensured and a burnishing ability is more improved. Therefore, the diameter is preferably 160 μm or more and more preferably 170 μm or more. Note that while the upper limit of the diameter of the fibers is not particularly limited, a thick fiber having an excessively large diameter causes a face of the fiber composite to be non-uniform, and leads to a case where uniform burnishing is difficult to be achieved; therefore, the upper limit is preferably 600 μm or less.

A fiber diameter in the present invention means a diameter when a cross section of a fiber is a circle and in a case where a cross section of a fiber is non-circular, a diameter of the fiber is defined to be one of a circle of the same sectional area as the non-circular fiber. Note that a cross section can be observed on an enlarged photograph from a scanning electron microscope.

A shape of the fiber composite is not particularly limited, but it is preferable that it is lock-like fiber composite in which adjacent fibers are bonded at intersection thereof. Bonding at intersection makes the shape maintain even if the burnishing pad is rotated while being in contact with a floor. The lock-like fiber composite may be the same one according to the first aspect of the invention.

Such a fiber composite is preferably entangled by needles (a needle-punching) so that fibers are hard to be loosened and separated off in burnishing, no interlayer separation occurs in the fiber composite itself in burnishing, and a proper elasticity is obtained so as to be well conformable with a floor face. A level of fiber-entanglement by needles has only to be adjusted in any suitable way to ensure the above effects, but it is not particularly limited.

A unit area weight of the fiber composite is not particularly limited, but is preferable 1,000 g/m$^2$ or less so as to lighten a burnishing pad. On the other hand, the unit area weight is preferably 300 g/m$^2$ or more so as to maintain a necessary strength in burnishing.

Note that a unit area weight is a value obtained by converting a value from a weight of a fiber composite and a face area of the fiber composite (an area of the face on the assumption that the face is a smooth plane) to a weight per 1 m$^2$.

Since the burnishing pad of the second aspect of the present invention is generally rotated when being used, a shape thereof is usually a disk.

In addition, since a diameter of a disk-like burnishing pad depends on a size of a burnishing machine, no specific limitation is placed thereon, but the diameter is preferably in the range of 100 to 800 mm, more preferably in the range of 200 to 700 mm and further preferably in the range of 300 to 600 mm.

The burnishing pads of the first and second aspects are comprised of a fiber composite of a vegetable fiber and the like, no harmful gas is generated in a state burned and the pad is biodegradable in a state buried in underground, no environmental pollution occurs when the pad is thrown away as waste.

The burnishing pad of the invention is generally used by attaching to a burnishing machine. And the burnishing pad is preferably comprised of a fiber composite and a supporting layer laminated to at least one side of this composite for the purpose of making an equipment of the burnishing pad to a burnishing machine easy, reducing deformation of the burnishing pad in burnishing and other reason. The fiber composite may be located so as to sandwitch the supporting layer. In the present invention, the supporting layer is preferably a porous one.

The porous supporting layer according to the present invention is literally porous. Heat generated due to friction in burnishing is not confined within a fiber composite on one side to transfer the heat in the fiber composite on the side in contact with a floor face to the fiber composite at the other face through a porous supporting layer and to further enable the heat to be radiated from the face of the fiber composite on the other side with the result that a increase in temperature can be suppressed, thereby leading to an advantage that an influence of heat can be restricted to the lowest level. In a case where a burnishing pad is washed with water or the like for reuse, an advantage is enjoyed that drying the support is easy because of permeability.

A material constituting the porous supporting layer is not particularly limited and it is preferably to have a mean 5% modulus strength at 70° C. (hereinafter also referred to as a "high temperature modulus strength") of 20 N/5 cm width or more. If a high temperature modulus strength is less than 20 N/5 cm width, a burnishing pad is greatly affected by an influence of heat in addition to an influence of a centrifugal force in burnishing, extends its edge to outside, increases the outer diameter and enhances a possibility to come into contact of the outer frame in the neighborhood of the burnishing pad in a burnishing machine; therefore, a high temperature modulus strength is preferably 25 N/5 cm width or more, more preferably 30 N/5 cm width or higher and further preferably 35 N/5 cm width or more.

A mean 5% modulus strength at 70° C. is obtained in the following way.

(1) Eight specimens A and eight specimens B of porous supporting layers were prepared by cutting; dimensions were as follows: a specimen A was of 200 mm in length direction and 50 mm in width direction and a specimen B was of 50 mm in length direction and 200 mm in width direction.

(2) The specimens A and B prepared according to (1) were subjected to measurements with a tensile strength tester "Tensilon UCT-500" (manufactured by Orientech Inc.) equipped with a high temperature thermostat "TKC-U2" (manufactured by Yashima Seisakujo K.K.) for the tensile strength tester and conditions for the measurements were as follows: a specimen was fixed between chucks of the tensile strength tester "Tensilon UCT-500" at a distance of 100 mm, a space including the chucks was held at 70° C., an end of the specimen was pulled away from the other end at a displacement speed of 200 mm/min. and a stress was measured when an inter-chuck distance reaches 105 mm.

(3) An arithmetic mean of stresses measured as results of procedures (1) and (2) described above is adopted as a "mean 5% modulus strength at 70° C."

A unit area weight of a porous supporting layer is 100 $g/m^2$ or less and preferably 80 $g/m^2$ so as to lighten a burnishing pad. If the unit area weight is excessively small, there arises a tendency of difficulty in securing high temperature modulus strengths as described above; therefore, the unit area weight is preferably 20 $g/m^2$ or more. The unit area weight is a value obtained by converting a value from a weight of a porous supporting layer and a face area of the porous supporting layer (an area on the assumption that a face is a smooth plane) to a weight per 1 $m^2$.

The porous supporting layer includes a long fiber (filament) non-woven fabric, a warp weft orthogonal non-woven fabric (for example, "Warif" of a registered trade mark), a net and the like. These porous supporting layers can be preferably used since a material thereof is of light weight and has strength at a high temperature. Among them, a long fiber (filament) non-woven fabric is preferable since fibers are substantially continuous and therefore, excellent in strength.

A spunbonded non-woven fabric among long fiber non-woven fabrics is preferable since long fibers can be oriented in random directions with excellent strength in any direction and elongation in any direction can be suppressed even if a centrifugal force due to rotation acts thereon. A fiber diameter of each of long fibers constituting a spunbonded non-woven fabric is not particularly limited, but the diameter is preferably in the range of 15 to 40 $\mu$m, which ensures excellence in strength.

A resin constituting the porous supporting layer has preferably a high melting point (150 ° C. or higher) so as to be excellent in high temperature modulus strength. The resin preferably includes polyamide resin, polyester resin, polypropylene resin and the like. Preferably includes polyamide resin and/or polyester resin, more preferably includes polyester resin and is further preferably made of only polyester resin.

A shape of the porous supporting layer is not particularly limited, but it may be the same as the fiber composite described above or the one having a shorter outer diameter than the fiber composite. And a thickness of the layer is not also limited. Further, the porous supporting layer may be one layer or in combination of two or more layers.

The porous supporting layer may also be bonded with a solvent type or emulsion type adhesive agent similarly to a case of forming the fiber composite as described above.

The burnishing pad may be the one including a porous supporting layer between fiber composites, however, the fiber composites and the porous supporting layer can be adhered to each other with an adhesive agent. That is, neither a needle nor the like passes through the porous supporting layer, which does not reduce strength of the porous supporting layer, to thereby, prevent the burnishing pad from being put into contact with the outer frame in the neighborhood of the burnishing pad in the burnishing machine under an adverse influence of a rotational force and heat.

No specific limitation is placed on adhesive agents but any can be used as far as it can rigidly adhere between each of fiber composites and a porous supporting layer, and a solvent type adhesive agent is preferably used so that a rigid adhesion can be realized. An adhesive agent includes poly vinyl acetate resin adhesive agent, polyurethane adhesive agent, nitrile-rubber adhesive agent, chloroprene rubber adhesive agent and the like.

An amount of the adhesive agent has only to be an amount with which there can be obtained strength of the order of a value at which a thick fiber composite and a porous supporting layer are not separated away from each other in burnishing, and no specific limitation is placed thereon since an amount is different depending on a kind of thick fibers, a kind of the porous supporting layer, a kind of the adhesive agent and the like, but a proper range in amount of the adhesive agent can be set through repetition of experiments.

Adhesion between each of fiber composites and a porous supporting layer with such an adhesive agent can be performed by a procedure in which the adhesive agent is coated on fiber composites and/or a porous supporting layer, followed by superimposing them one on another and drying them in the state under a pressure when required to remove an organic solvent in the adhesive agent. Drying for removal of the organic solvent may be performed either under a atmospheric pressure at tens of degrees centigrade over a long time, at a high temperature of 100° C. or higher within a short time, at tens of degrees centigrade under a reduced pressure in a vacuum dryer, or by air drying at an environmental temperature.

In the burnishing pad comprised of fiber composites and a porous supporting layer located between the fiber composites, each fiber composite may be the same or different, respectively. In addition, a fiber composite in which a kind of fiber, a kind of an adhesive agent, an amount of the adhesive agent, a unit area weight, a thickness and the like are different, may be used.

Use of a porous supporting layer having strength in the case it is light or under a high temperature described above leads to reducing a load on a motor of a burnishing machine, and at the same time, a burnishing pad does not come into contact with the outer frame in the neighborhood of the burnishing pad in the burnishing machine even under influences of a rotational force and heat.

The burnishing pad having a supporting layer can be produced by adhering a fiber composite and a porous supporting layer, all being circular, to each other or alternatively adhering a fiber composite and a porous supporting layer, all being square, to each other, followed by punching them into the shape of a circle.

A thickness of the burnishing pad comprised of fiber composites and a porous supporting layer is preferably 5 to 50 mm, more preferably 10 to 40 mm, further preferably 20 to 35 mm. In the burnishing pad, the thickness of the fiber composite is preferably 5 to 20 mm, more preferably 10 to 18 mm. In addition, in the case the burnishing pad 1 whose fiber composite 21 & 22 are attached to both side of the porous supporting layer 4 is used (See FIG. 3), a thickness of each fiber composite is generally the same, but may be different.

It is preferable that a burnishing pad having a fiber composite, a porous supporting layer and an adhesive agent to adhere them to each other contains no abrasive agents. Without containing an abrasive agent, all of coated wax is not removed to facilitate only a part of the wax on a surface to be removed. Such an effect is conspicuous in a case where a fiber composite is mainly comprised of vegetable hard fibers.

The burnishing pad of the present invention may properly contain selectively other kinds of fibers, additive agents, for example a wax component, fats and fatty oils, and others, in the ranges in contents without no obstruction of the effect of the present invention in order to attain improvement or the like on elasticity, a frictional force and removal of dirt.

The burnishing machine of the present invention is not particularly limited as long as it is equipped with the burnishing pad described above. Example is a rotational driving type burnishing machine.

The burnishing machine of the present invention is equipped with a burnishing pad described above in contact with a floor face; a part of a wax surface is removed by rotating a face of the burnishing pad while pressing itself against the floor face; when burnishing the floor face, the burnishing pad does not come into contact with the outer frame in the neighborhood of itself in the burnishing machine even under influences of a rotational force and heat to thereby enable a burnishing to be smoothly performed, thereby enabling the burnishing machine to be a burnishing machine with a light weight and a long lifetime. Note that a burnishing machine of the present invention can burnish a floor face without using an abrasive agent and a detergent.

The burnishing method of the present invention is to burnish a dirty point using burnishing pads described above. The dirty point includes a surface of a floor, a wall and the like in a store, a supermarket, a department store, a building, a hall, a railway station and others. Burnishing of a dirt point without a detergent can be realized. Therefore, no necessity occur for preliminary arrangement, such as a step of supplying a detergent, which causes the pad to superior to a prior art practice in operability.

In addition, in the case where a detergent and the like is used as well, it is natural to be able to attain a sufficient level in burnishing and cleaning.

DESCRIPTION OF THE PREFERRED EMBODIMENTS

Figure 1:
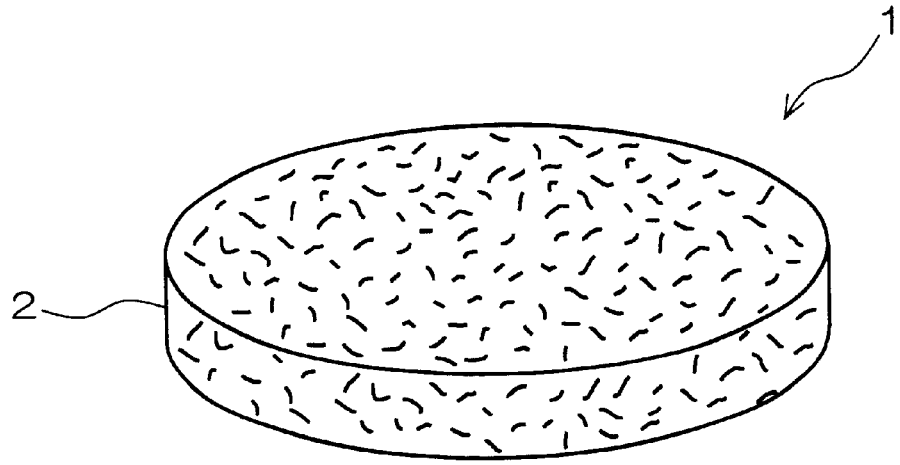
FIG. 1 is a schematic view as a model showing an example of a burnishing pad.
Figure 2:
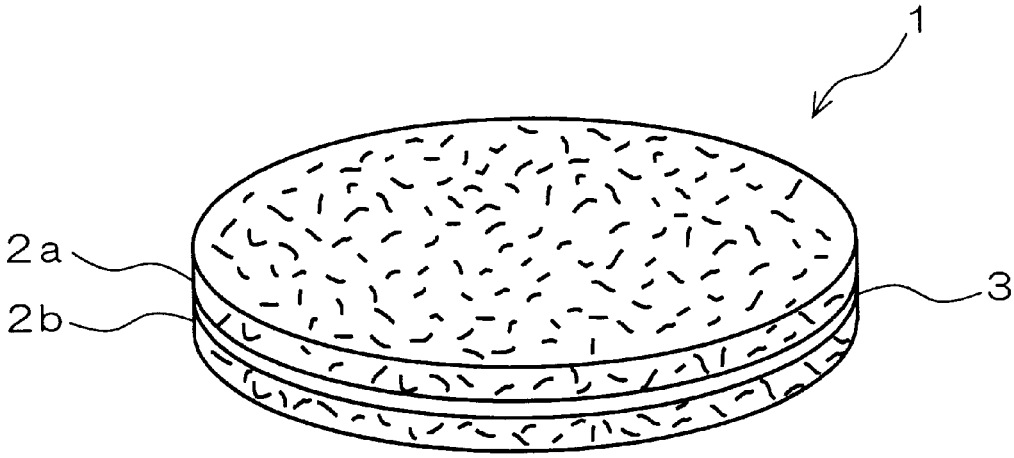
FIG. 2 is a schematic view as a model showing another example of a burnishing pad.
Figure 3:
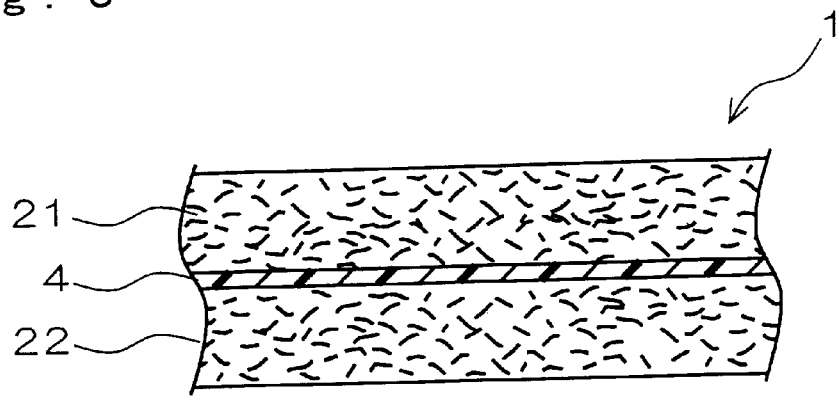
FIG. 3 is a schematic view as a model showing an example of a burnishing pad comprised of a fiber composite and a porous supporting layer.

The present invention will be explained more specifically by way of Examples below but the present invention is not limited by these Examples.

1-1. Production of Burnishing Pad

EXAMPLE 1

A lock-like fiber composite (fibers; sisal hemp, trade name; "sisal lock" manufactured by TOYO Cushion CO., LTD.) was used to prepare, a burnishing pad of the shape of a disk (an outer diameter; 260 mm, a thickness; 30 mm, and a weight; 1, 200 g/m$^2$).

Comparative Example 1

A lock-like chemical fiber composite (made of Nylon) was used to prepare a burnishing pad of the shape of a disk (an outer diameter; 260 mm, a thickness; 25 mm, and a weight; 800 g/m$^2$).

1-2. Evaluation on Performance of Burnishing Pad

The burnishing pads of Example 1 and Comparative Example 1 prepared in 1-1. above were each mounted to a fore end of a rotary shaft of a drilling machine (manufactured by Kichira Tekko-Jo Co., Ltd.) and burnished a vinyl tile (a size; 30×30 cm, a glossiness; 5 by the following measuring method) onto which oil, soil and sand dust were attached, at the number of rotations 1,630 rpm for 5 hours to measure a glossiness on each of surfaces to be burnished with a digital variable angle gloss meter "UGV-5K" (manufactured by Suga Shikenki Co., Ltd.) in conformity with JIS Z 8741. Note that a measuring hole for a glossiness was of 16×16 mm, a measuring angle was 60 degrees and a temperature was 22° C. Results of the measurement are shown in Table 1.

TABLE 1

| | Fiber used | Relative-specular glossiness Gs (60°) before burnishing | after burnishing |
|---|---|---|---|
| Example 1 | Sisal hemp | 5 | 28 |
| Comparative example 1 | Nylon | 5 | 22 |

1-3. Effect of Example

According to Table 1, the burnishing pad of Comparative Example 1 using the lock-like chemical fiber composite had a glossiness of 22 on a vinyl tile after burnishing (a glossiness thereof before burnishing is 5). In contrast to this, the burnishing pad of Example 1 using the lock-like fiber composite (fibers; sisal hemp) had a glossiness of 28 on a vinyl tile after burnishing, which was superior to that of Comparative Example 1 by a value as high as about 27%. For this reason, a burnishing pad made of the lock-like fiber composite was confirmed to be excellent in burnishing ability.

1-4. Study on Burnishing Effects of Burnishing Pads with Burnishing Machine

Test Example 1

A lock-like fiber composite (fibers; sisal hemp, trade name; "sisal lock" manufactured by TOYO Cushion CO., LTD.) was used to prepare a burnishing pad of the shape of a disk (an outer diameter; 510 mm, an inner diameter; 85 mm, a thickness; 20 mm).

Test Example 2

A lock-like fiber composite (fibers; palm fibers, trade name; "palm lock" manufactured by TOYO Cushion CO., LTD.) was used to prepare a burnishing pad of the shape of a disk (an outer diameter; 510 mm, an inner diameter; 85 mm, a thickness; 20 mm).

Test Example 3

A lock-like chemical fiber composite (made f Nylon) was used to prepare a burnishing pad of the shape of a disk (an outer diameter; 510 mm, an inner diameter; 85 mm, a thickness; 20 mm).

Test Example 4

A lock-like fiber composite similar to Test Example 1 was used to prepare two pads each of the shape of a disk (an outer diameter; 510 mm, an inner diameter; 85 mm, a thickness; 10 mm) and the pads were adhered to each other with an adhesive agent (thermoplastic resin emulsion) to prepare a burnishing pad.

1-5. Evaluation

The burnishing pads of Test Examples 1 to 4 prepared in 1-4. above were each mounted to a burnishing machine to burnish a floor face all over which oil, soil and sand dust attaching vinyl tiles are adhered without clearances between the tiles without using a detergent or the like altogether to evaluate with the naked eye.

As a result of the visual evaluation, in a case where the burnishing pad of Test Example 3 made of the lock-like chemical fiber composite, dirt on the vinyl tile was not removed sufficiently but a surface was a little lackluster. In contrast to this, in cases where there were used the burnishing pad of Test Example 1 made of the lock-like fiber composite (fibers; sisal hemp), the burnishing pad of Test Example 2—made of the lock-like fiber composite (fibers; palm fibers) and the burnishing pad of Test Example 4 obtained by adhering the pads made of the lock-like fiber composites (fibers; sisal hemp) to each other with the adhesive agent, dirt on all the vinyl tiles was sufficiently removed without being lackluster on all the surface; thereby having enabled a very excellent burnishing effect to be confirmed.

2-1. Production of Another Burnishing Pad

EXAMPLE 2

There was used 100% by weight of sisal hemp fibers (in the range of 260 to 435 $\mu$m in fiber diameter) and thick fiber composite precursors were obtained by accumulation in an air laying process, followed by needle-punching to form entangled thick fiber composite precursors (a unit area weight; 420 g/m$^2$).

Then, a polyacrylate emulsion adhesive agent was sprayed on one face of a entangled fiber composite precursor, thereafter the entangled fiber composite precursor was dried, subsequently the polyacrylate emulsion adhesive agent was sprayed on the other face thereof, thereafter the entangled fiber composite precursor was dried and heated at 150° C. to cure the adhesive agent and to adhere fibers therein to each other with a total amount of the adhesive agent of 330 g/m$^2$ and a thickness of the entangled fiber composite precursor was adjusted by passing it through a pair of rolls to prepare a thick fiber composite (a unit area weight; 750 g/m$^2$ and a thickness; 14 mm). Two thick fiber composites were thus prepared.

On the other hand, a spunbonded non-woven fabric (a unit area weight; 50 g/m$^2$) was prepared by melt-bonding a mixture of polyester long fibers (a fiber diameter; 30 $\mu$m) and a low melting point polyester long fibers (a fiber diameter; 30 $\mu$m) in a mixing ratio of 8 to 2 in mass with low melting point polyester long fibers. A mean 5% modulus strength at 70° C. of the spunbonded non-woven fabric was 37 N/5 cm width.

Then, a chloroprene-rubber solvent type adhesive agent was coated on one face of each of the thick fiber composites and both faces of the spunbonded non-woven fabric at 50 g/m$^2$ of the adhesive agent each and thereafter, the adhesive agent coated faces of the respective thick fiber composites are superimposed on the spunbonded non-woven fabric in contact with each other, followed by air drying at environmental temperature for one night to cause the thick fiber composites and the spunbonded non-woven fabric to be adhered to each other only by an action of the adhesive agent. Fabricated was a burnishing pad (a unit area weight; 1,750 g/m$^2$ and a thickness; 28 mm) in the shape of a square with the spunbonded non-woven fabric interposed between the thick fiber composites without containing an abrasive agent.

Then, the square burnishing pad was punched into a doughnut disk (an outer diameter; 500 mm and an inner diameter; 84 mm) to fabricate a disk-like burnishing pad.

Reference Example

Prepared was two thick fiber composites (a unit area weight; 750 g/m$^2$ and a thickness; 14 mm) fabricated in a similar manner to Example 2. Then, a chloroprene-rubber solvent type adhesive agent was coated on one face of each of the thick fiber composites at 50 g/m$^2$ of the adhesive agent and thereafter, the thick fiber composites are superimposed on the respective adhesive agent coated faces so as to be in contact with each other, followed by air drying at environmental temperature for one night to cause the superimposed composites to be adhered to each other only by an action of the adhesive agent. Fabricated was a burnishing pad (a unit area weight; 1,600 g/m$^2$ and a thickness; 28 mm) in the shape of a square constituted of only the thick fiber composites without containing an abrasive agent.

Then, the square burnishing pad was punched into a doughnut disk (an outer diameter; 500 mm and an inner diameter; 84 mm) to fabricate a disk-like burnishing pad.

2-2. Evaluation of Shape Sustainability

The disk-like burnishing pads of Example 2 and Reference Example are mounted to a burnishing machine ("SP-2500" manufactured by Johnson Co., Ltd.) and thereafter an operation, similar to a burnishing operation, in which a disk-like burnishing pad was rotated on an iron plate for 20 minutes at the number of rotations of 2,500 rpm, was repeated three runs to measure a difference between outer diameters of the disk-like burnishing pad before and after the three operations. The measurement was performed at two sites on one diameter selected at random on a disk-like burnishing pad and a diameter orthogonal to the first diameter to obtain an arithmetic mean of the measured values. Note that the three operations were performed at intervals of about three minutes. It is understood that a difference between outer diameters equal to or less than 7 mm prevents a burnishing pad from coming into contact with the outer frame in the neighborhood of the burnishing pad in the burnishing machine to enable a smooth burnishing operation. Results of Example 2 and Reference Example were as shown in Table 2.

TABLE 2

| | Unit area weight (g/m$^2$) | Difference between outer diameters (mm) |
|---|---|---|
| Example 2 | 1,750 | 7 |
| Reference example | 1,600 | 11 |

As is clear from the results of Table 2, a burnishing pad of the present invention comes into no contact with the outer frame in the neighborhood of the burnishing pad in a burnishing machine to enable a smooth burnishing operation and it can be predicted that a load on a burnishing machine is small because of light weight.

What is claimed is:

1. A burnishing pad comprising a fiber composite in which fibers intersecting and adjacent to each other are bonded, wherein said fibers comprise at least one type of fiber selected from the group consisting of a vegetable fiber, a synthetic fiber and an animal fiber, and at least 60% by weight of said fibers comprise vegetable fibers.

2. The burnishing pad according to claim 1, wherein said vegetable fiber is at least one selected from the group consisting of sisal hemp fiber, palm fiber, manila hemp fiber, cellulose fiber and bass fiber.

3. The burnishing pad according to claim 1, wherein said animal fiber is at least one selected from the group consisting of human hair, pig hair, sheep hair, goat hair, horse hair, deer hair, rabbit hair, wild boar hair and camel hair.

4. The burnishing pad according to claim 1, further comprising a porous supporting layer provided on one side of said fiber composite or interposed between plural portions of said fiber composite.

5. A burnishing pad comprising a fiber composite in which fibers intersecting and adjacent to each other are bonded, wherein said fibers comprise at least one type of fiber selected from the group consisting of a vegetable fiber, a synthetic fiber and an animal fiber, at least 60% by weight of said fibers comprise vegetable fibers, and each of said fibers has a diameter in a range between 150 $\mu$m and 600 $\mu$m in fiber diameter.

6. The burnishing pad according to claim 5, wherein said vegetable fiber is at least one selected from the group consisting of sisal hemp fiber, palm fiber, manila hemp fiber, cellulose fiber and bass fiber.

7. The burnishing pad according to claim 5, further comprising a porous supporting layer provided on one side of said fiber composite or interposed between plural portions of said fiber composite.

8. The burnishing pad according to claim 7, wherein said porous supporting layer has a mean 5% modulus strength of 20 N/5 cm width or more at 70° C. and a unit area weight of 100 g/m$^2$ or less.

9. The burnishing pad according to claim 7, wherein said porous supporting layer comprises at least one material selected from the group consisting of a long fiber non-woven fabric, a warp weft orthogonal non-woven fabric and a net.

10. The burnishing pad according to claim 9, wherein said long fiber non-woven fabric is a spunbonded non-woven fabric.

11. A burnishing machine comprising a burnishing pad including a fiber composite in which fibers intersecting and adjacent to each other are bonded, wherein said fibers comprise at least one type of fiber selected from the group consisting of a vegetable fiber, a synthetic fiber and an animal fiber, and at least 60% by weight of said fibers comprise vegetable fibers.

12. The burnishing machine according to claim 11, wherein said burnishing pad further comprises a porous supporting layer provided on one side of said fiber composite or interposed between plural portions of said fiber composite.

13. A burnishing machine comprising a burnishing pad including a fiber composite in which fibers intersecting and adjacent to each other are bonded, wherein said fibers comprise at least one type of fiber selected from the group consisting of a vegetable fiber, a synthetic fiber and an animal fiber, at least 60% by weight of said fibers comprise vegetable fibers, and each of said fibers has a diameter in a range between 150 $\mu$m and 600 $\mu$m in fiber diameter.

14. The burnishing machine according to claim 13, wherein said burnishing pad comprises further a porous supporting layer provided on one side of said fiber composite or interposed between plural portions of said fiber composite.

15. The burnishing machine according to claim 14, wherein said porous supporting layer has a mean 5% modulus strength of 20 N/5 cm width or more at 70° C. and a unit area weight of 100 g/m$^2$ or less.

16. A burnishing method comprising:

preparing a burnishing pad comprising a fiber composite in which fibers intersecting and adjacent to each other are bonded; and burnishing a dirty point using said burnishing pad, wherein said fibers comprise at least one type of fibers selected from the group consisting of a vegetable fiber, a synthetic fiber and an animal fiber, and at least 60% by weight of said fibers comprise vegetable fibers.

17. The burnishing method according to claim 16, wherein said burnishing is performed without a detergent and an abrasive agent.

18. A burnishing method comprising:

preparing a burnishing pad comprising a fiber composite having fibers whose diameters are in a range between 150 $\mu$m and 600 $\mu$m in fiber diameter; and burnishing a dirty point using said burnishing pad, wherein said fibers comprise at least one type of fibers selected from the group consisting of a vegetable fiber, a synthetic fiber and an animal fiber, and at least 60% by weight of said fibers comprise vegetable fibers.

19. The burnishing method according to claim 18, wherein said burnishing is performed without a detergent and an abrasive agent.

* * * * *